US005396875A

United States Patent [19]

Kotwicki et al.

[11] Patent Number: 5,396,875

[45] Date of Patent: Mar. 14, 1995

[54] AIR/FUEL CONTROL WITH ADAPTIVELY LEARNED REFERENCE

[75] Inventors: Allan J. Kotwicki, Sterling Heights; Jeffrey A. Doering, Dearborn; Michael P. Falandino, Wyandotte, all of Mich.

[73] Assignee: Ford Motor Company, Dearborn, Mich.

[21] Appl. No.: 193,592

[22] Filed: Feb. 8, 1994

[51] Int. Cl.[6] ..... F02D 41/14

[52] U.S. Cl. ..... 123/681; 123/695

[58] Field of Search ..... 123/695, 681, 689

[56] References Cited

U.S. PATENT DOCUMENTS

| | | | |
|---|---|---|---|
| 3,973,529 | 8/1976 | Wessel et al. | 123/676 |
| 4,109,615 | 8/1978 | Asano | 123/686 |
| 4,120,269 | 10/1978 | Fujishiro | 123/695 |
| 4,132,200 | 1/1979 | Asano et al. | 123/694 |
| 4,170,965 | 10/1979 | Aono | 123/695 |
| 4,187,806 | 2/1980 | Schnurle et al. | 123/695 |
| 4,458,319 | 7/1984 | Chujo et al. | 123/695 |
| 4,459,669 | 7/1984 | Chujo et al. | 123/695 |

OTHER PUBLICATIONS

Regelung der Gemischzusammensetzung bei Einspritz-Ottomotoren mit Hilfe der Lambda-Sonde, Bosch Techn. Berichte 6 (1978) (month unknown).

*Primary Examiner*—Andrew M. Dolinar

*Attorney, Agent, or Firm*—Allan J. Lippa; Roger L. May

[57] ABSTRACT

An engine air/fuel control system includes an apparatus and method for adaptively learning a reference voltage. Fuel delivered to the engine is trimmed by a feedback variable provided by integrating a two-state signal resulting from a comparison between the reference voltage and the exhaust gas oxygen sensor output. Each sample period of a microprocessor, a high voltage signal and low voltage signal are generated which track the outer envelope of the sensor signal. Calculation of a midpoint between high and low voltage signals provides the reference which instantaneously tracks the midpoint of the sensor signal.

13 Claims, 5 Drawing Sheets

AIR/FUEL CONTROL WITH ADAPTIVELY LEARNED REFERENCE

BACKGROUND OF THE INVENTION

The field of the invention relates to control systems for maintaining engine air/fuel operation in response to an exhaust gas oxygen sensor.

Feedback control systems responsive to exhaust gas oxygen sensors which attempt to maintain engine air/fuel ratio near the peak efficiency window of a catalytic converter are well known, The sensor output is typically compared to a reference value which under ideal conditions is at the approximate midpoint in expected peak-to-peak excursion of the sensor output, A two-state signal is thereby generated which indicates when engine air/fuel operation is either rich or lean of a predetermined air/fuel ratio such as stoichiometry. In an attempt to compensate for fluctuations in the sensor output due to deterioration, contamination of the electrodes, or low operating temperature, an approach was disclosed in U.S. Pat. No. 4,170,965 to time average the sensor output through an RC filter, and use the time averaged value as the reference value.

The inventors herein have recognized several problems with the above approach. Using a time averaged output of the EGO sensor as the comparison reference will not always result in alignment of the reference with the midpoint in peak-to-peak excursion of the EGO sensor output. Because such a value is an average of past history, it will not track rapid shifts in the sensor output. Such shifts may occur, for example, when the sensor heater has not stabilized. Sensor temperature is then dependent on engine operating conditions so that sudden temperature changes may occur resulting in abrupt shifts of the sensor output in either a lean or a rich direction. Shifts in the sensor output may also be caused by changes in exhaust pressure. For these and other reasons, the switch point in the sensor output may not be in perfect alignment with the peak efficiency operating window of the catalytic converter.

SUMMARY OF THE INVENTION

An object of the invention herein is to correct for voltage shifts in the EGO sensor output which may occur with sensor aging, electrode contamination, or changes in operating temperature.

The above object is achieved and problems of prior approaches overcome by providing an air/fuel control method and control system for an internal combustion engine. In one particular aspect of the invention, the method comprises the steps of: adjusting fuel delivered to the engine in response to a comparison of an output from an exhaust gas oxygen sensor to an adaptively learned reference signal; generating the adaptively learned reference signal by determining a linear interpolation between a first signal and a second signal; and generating the first signal by storing the sensor signal as the first signal when the sensor signal is greater than a previously stored first signal and holding the first signal when the sensor signal is less than a previously stored reference signal and decreasing the first signal at a predetermined rate when the sensor signal is greater than the previously stored reference signal but less than the previously stored first signal.

Preferably, the second signal is generated by storing the sensor signal as the second signal when the sensor signal is less than a previously stored second signal and holding the second signal when the sensor signal is greater than a previously stored reference signal and increasing the second signal by a predetermined amount when the sensor signal is less than the previously stored reference signal but greater than the previously stored second signal.

An advantage of the above aspects of the invention is that the reference signal is repeatedly adjusted so that it always tracks the midpoint in peak-to-peak excursion of the sensor output, even when the sensor output is rapidly shifting. A further advantage is that the reference signal will track the sensor output midpoint regardless of whether the sensor is shifting lean or shifting rich.

BRIEF DESCRIPTION OF THE DRAWINGS

The object and advantages of the invention claimed herein and others will be more clearly understood by reading an example of an embodiment in which the invention is used to advantage with reference to the attached drawings wherein:

DESCRIPTION OF AN EMBODIMENT

Figure 1:
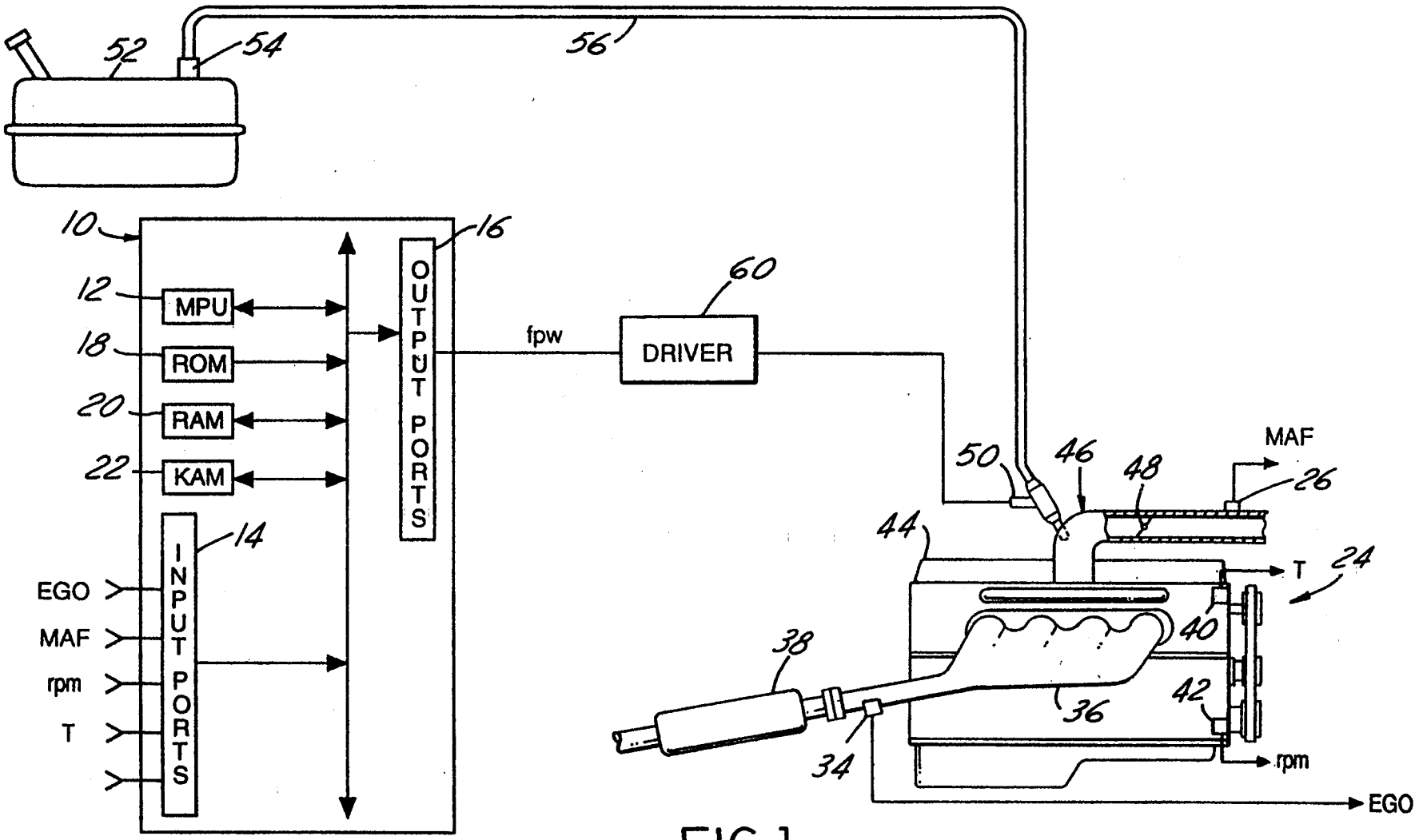
FIG. 1 is a block diagram of an embodiment wherein the invention is used to advantage.

Controller 10 is shown in the block diagram of FIG. 1 as a conventional microcomputer including: microprocessor unit 12; input ports 14 including both digital and analog inputs; output ports 16 including both digital and analog outputs; read only memory (ROM) 18 for storing control programs; random access memory (RAM) 20 for temporary data storage which may also be used for counters or timers; keep-alive memory (KAM) 22 for storing earned values; and a conventional data bus.

In this particular example, exhaust gas oxygen (EGO) sensor 34 is shown inserted in exhaust manifold 36 of engine 34 upstream of conventional catalytic converter 38. Tachometer 42 and temperature sensor 40 are each shown coupled to engine 24 for providing, respectively, signal rpm related to engine speed and signal T related to engine coolant temperature to controller 10.

Intake manifold 44 of engine 24 is shown coupled to throttle body 46 having primary throttle plate 48 positioned therein. Throttle body 46 is also shown having fuel injector 50 coupled thereto for delivering liquid fuel in proportion to pulse width signal fpw from controller 10. Fuel is delivered to fuel injector 50 by a conventional fuel system including fuel tank 52, fuel pump 54, and fuel rail 56.

Figure 2:
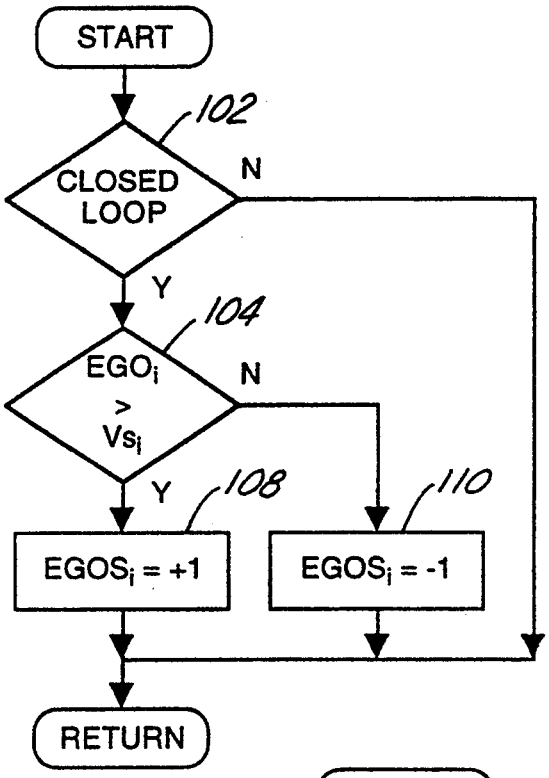
FIGS. 2–5 are high level flowcharts illustrating various steps performed by a portion of the embodiment illustrated in FIG. 1.

Referring now to FIG. 2, two-state signal EGOS is generated by comparing signal EGO from sensor 34 to adaptively learned reference value Vs. More specifically, when various operating conditions of engine 24, such as temperature (T), exceed preselected values, closed-loop air/fuel feedback control is commenced (step 102). Each sample period of controller 10, the output of sensor 34 is sampled to generate signal $EGO_i$. Each sample period (i) when signal $EGO_i$ is greater than adaptively learned reference or set voltage $Vs_i$ (step 104), signal $EGOS_i$ is set equal to a positive value such as unity (step 108). On the other hand, when signal $EGO_i$ is less than reference value $Vs_i$ (step 104) during sample time (i), signal $EGOS_i$ is set equal to a negative value such as minus one (step 110). Accordingly, two-state signal EGOS is generated with a positive value indicating exhaust gases are rich of a desired air/fuel ratio such as stoichiometry, and a negative value when exhaust gases are lean of the desired air/fuel ratio. In response to signal EGOS, feedback variable FFV is generated as described later herein with particular reference to FIG. 4 for adjusting the engine's air/fuel ratio.

Figures 3, 4:
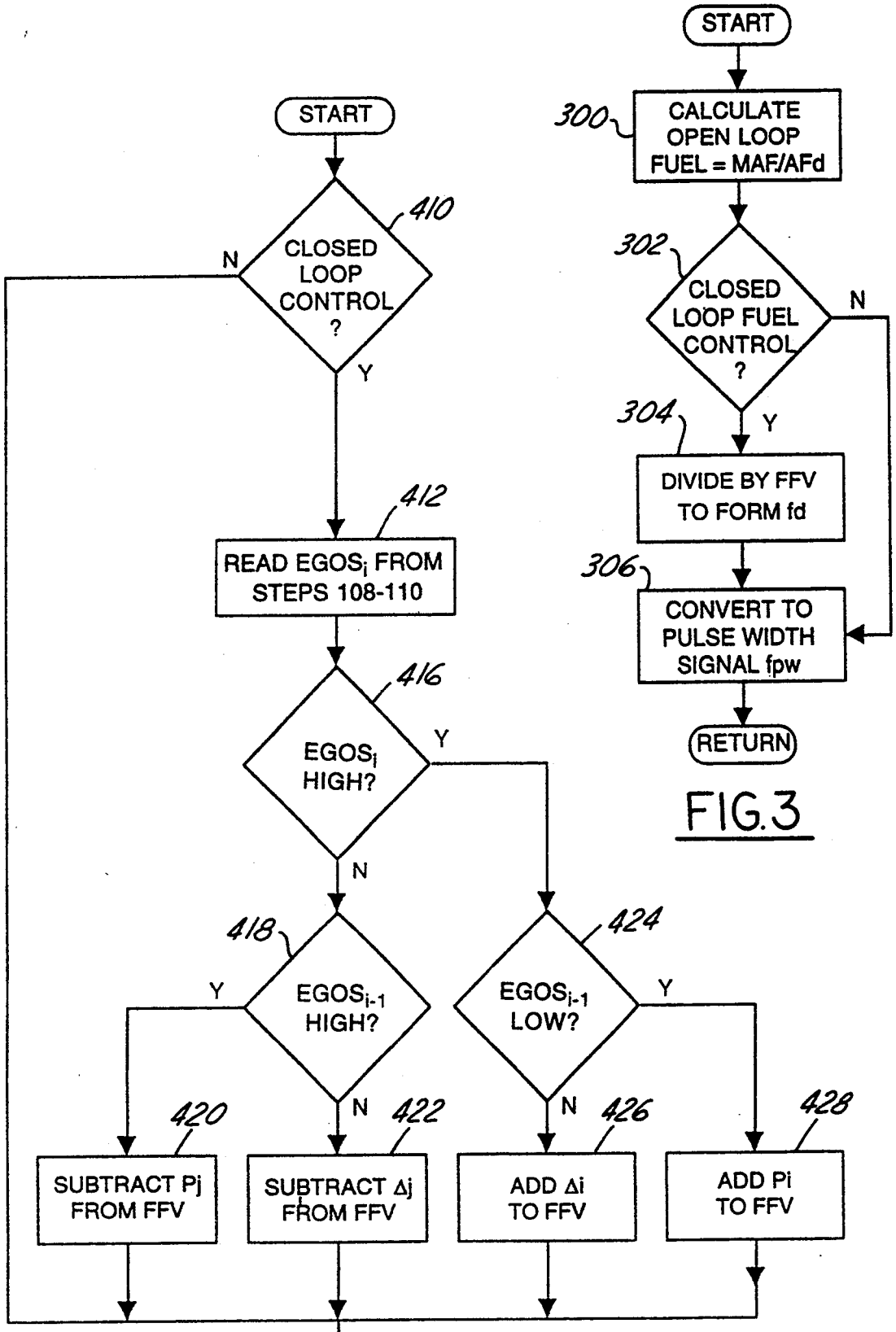

A flowchart of the liquid fuel delivery routine executed by controller 10 for controlling engine 24 is now described beginning with reference to the flowchart shown in FIG. 3. An open loop calculation of desired liquid fuel is first calculated in step 300. More specifically, the measurement of inducted mass airflow (MAF) from sensor 26 is divided by a desired air/fuel ratio (AFd) correlated with stoichiometric combustion. After a determination is made that closed loop or feedback control is desired (step 302), the open loop fuel calculation is trimmed by fuel feedback variable FFV to generate desired fuel signal fd during step 304. This desired fuel signal is converted into fuel pulse width signal fpw for actuating fuel injector 50 (step 306) via injector driver 60 (FIG. 1).

The air/fuel feedback routine executed by controller 10 to generate fuel feedback variable FFV is now described with reference to the flowchart shown in FIG. 4. After closed control is commenced (step 410), signal $EGOS_i$ is read during sample time (i) from the routine previously described with respect to steps 108–110. When signal $EGOS_i$ is low (step 416), but was high during the previous sample time or background loop (i−1) of controller 10 (step 418), preselected proportional term Pj is subtracted from feedback variable FFV (step 420). When signal $EGOS_i$ is low (step 416), and was also low during the previous sample time (step 418), preselected integral term Δj is subtracted from feedback variable FFV (step 422).

Similarly, when signal EGOS is high (step 416), and was also high during the previous sample time (step 424), integral term Δi is added to feedback variable FFV (step 426). When signal EGOS is high (step 416), but was low during the previous sample time (step 424), proportional term Pi is added to feedback variable FFV (step 428).

Adaptively learning set or reference Vs is now described with reference to the subroutine shown in FIG. 5. For illustrative purposes, reference is also made to the hypothetical operation shown by the waveforms presented in FIGS. 6A and 6B. In general, adaptively learned reference Vs is determined from the midpoint between high voltage signal Vh and low voltage signal Vl. Signals Vh and Vl are related to the high and low values of signal EGO during each of its cycles with the addition of several features which enables accurate adaptive learning under conditions when signal EGO may become temporarily pegged at a rich value, or a lean value, or shifted from its previous value.

Figure 5:
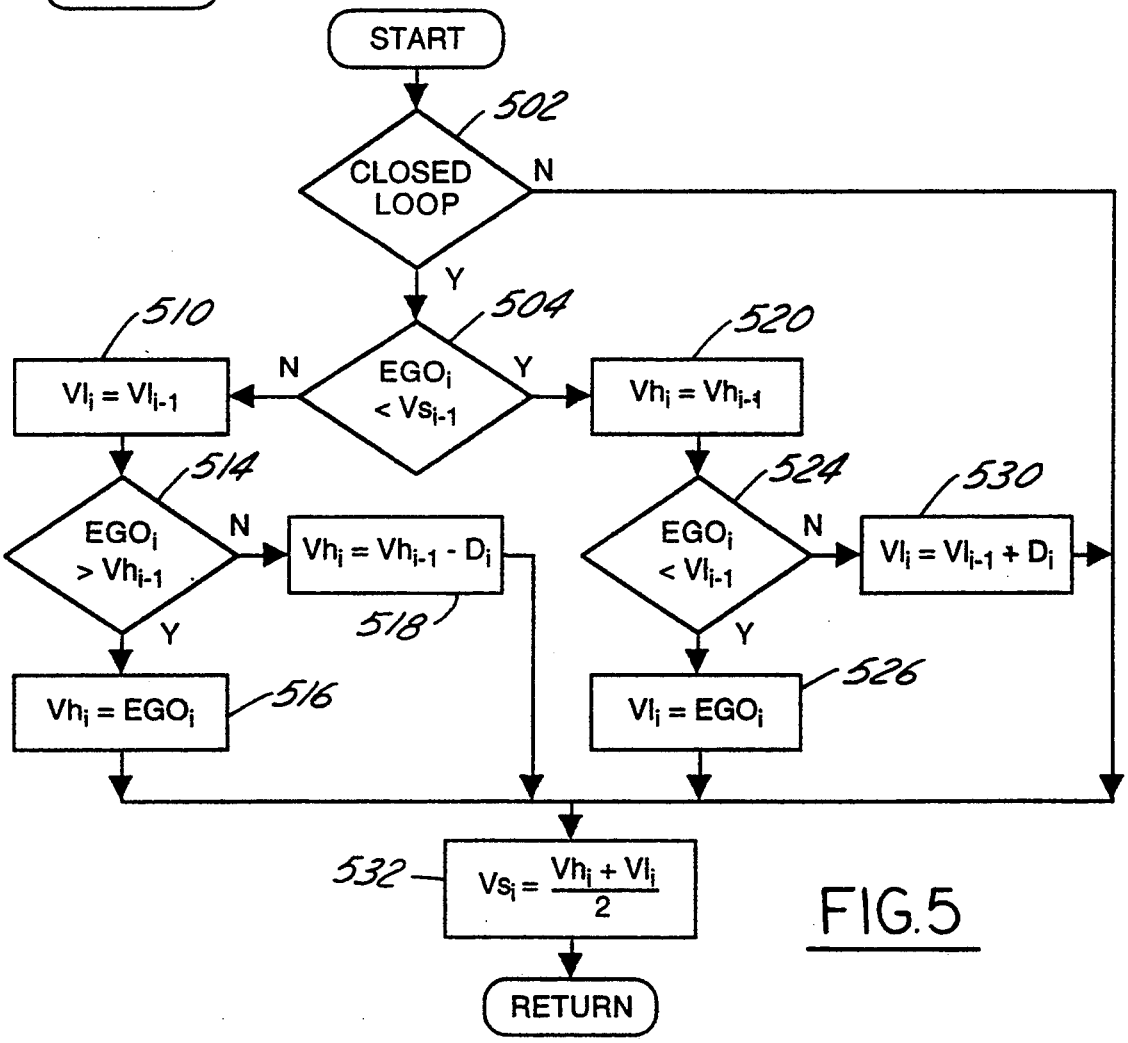

Referring first to FIG. 5, after closed loop air/fuel control is commenced (step 502), signal $EGO_i$ for this sample period (i) is compared to reference $Vs_{i-1}$ which was stored from the previous sample period (i −1) in step 504. When signal $EGO_i$ is greater than previously sampled signal $Vs_{i-1}$, the previously sampled low voltage signal $Vl_{i-1}$ is stored as low voltage signal $Vl_i$ for this sample period (i) in step 510. This operation is shown by the graphical representation of signal Vl before time t2 shown in FIG. 6A. Returning to FIG. 5, when signal $EGO_i$ is greater than previously sampled high voltage signal $Vh_{i-1}$ (step 514), signal $EGO_i$ is stored as high voltage signal $Vh_i$ for this sample period (i) in step 516. This operation is shown in the hypothetical example of FIG. 6A between times t1 and t2.

Figure 6A:
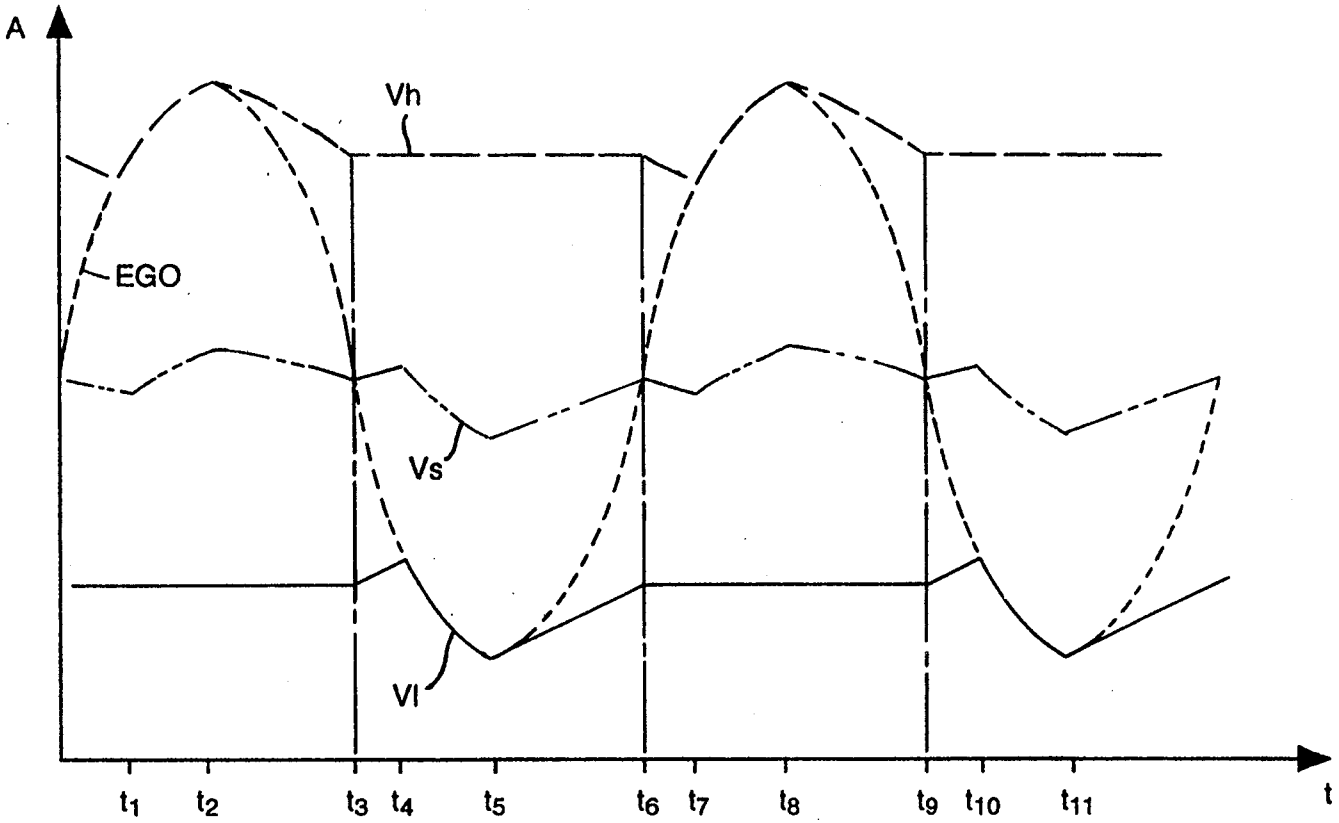
FIGS. 6A, 6B, 7, and 8 illustrate various outputs associated with a portion of the embodiment illustrated in FIG. 1.
Figure 6B:
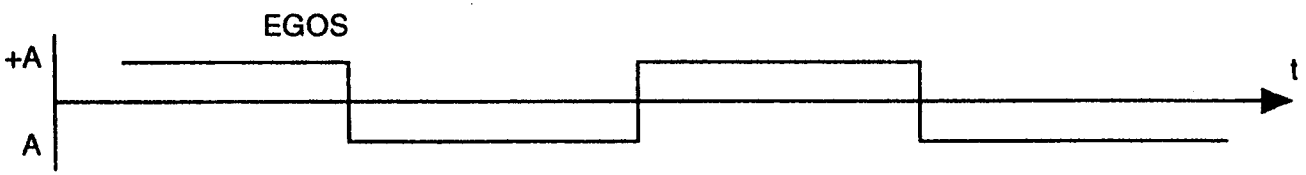

When signal $EGO_i$ is less than previously stored high voltage signal $Vh_{i-1}$ (step 514), high voltage signal $Vh_i$ is set equal to previously sampled high voltage $Vh_{i-1}$ less predetermined amount $D_i$ which is a value corresponding to desired signal decay (step 518). This operation is shown in the hypothetical example presented in FIG. 6A between times t2 and t3. As shown in FIG. 6A, high voltage signal Vh decays until signal $EGO_i$ falls to a value less than reference Vs at which time high voltage signal Vh is held constant. Referring to the corresponding operation shown in FIG. 5, high voltage signal $Vh_i$ is stored as previously sampled high voltage signal $Vh_{i-1}$ (step 520) when signal $EGO_i$ is less than previously sampled reference $Vs_{i-1}$ (step 504).

Continuing with FIG. 5, when signal $EGO_i$ is less than both previously sampled reference $Vs_{i-1}$ and previously sampled low voltage signal $Vl_{i-1}$ (step 524) signal $EGO_i$ is stored as low voltage signal $Vl_i$ (step 526). An example of this operation is presented in FIG. 6A between times t4 and t5.

When signal $EGO_i$ is less than previously sampled reference $Vs_{i-1}$ (step 504), but greater than previously sampled high voltage signal $Vl_{i-1}$ (step 524), high voltage signal $Vl_i$ is set equal to previously sampled high voltage signal $Vl_{i-1}$ plus predetermined decay value $D_i$ (step 530). An example of this operation is shown graphically in FIG. 6A between times t5 and t6.

As shown in step 532 of FIG. 5, reference $Vs_i$ is calculated each sample period (i) in this example by finding the midpoint between high voltage signal $Vh_i$ and low voltage signal $Vl_i$ each sample time (i). Linear interpolation of Vh and Vl other than the midpoint may also be used to advantage (e.g., $(\partial Vh+(1-\partial)Vl)/2$).

Referring to the hypothetical example presented in FIGS. 6A and 65, signal EGOS is set at a high output amplitude (+A) when signal EGO is greater than reference Vs and set at a low value (−A) when signal EGO is less than reference Vs.

In accordance with the above described operation, reference Vs is adaptively learned each sample period so that signal EGOS is accurately determined regardless of any shifts in the output of signal EGO. In addition, only allowing Vh and Vl to decay when the EGO signal is above or below the sensor set point respectively prevents learning on invalid set point when air/fuel operation runs rich or lean for prolonged periods of time. Such operation may occur during either wide-open throttle conditions or deceleration conditions.

Figure 7:
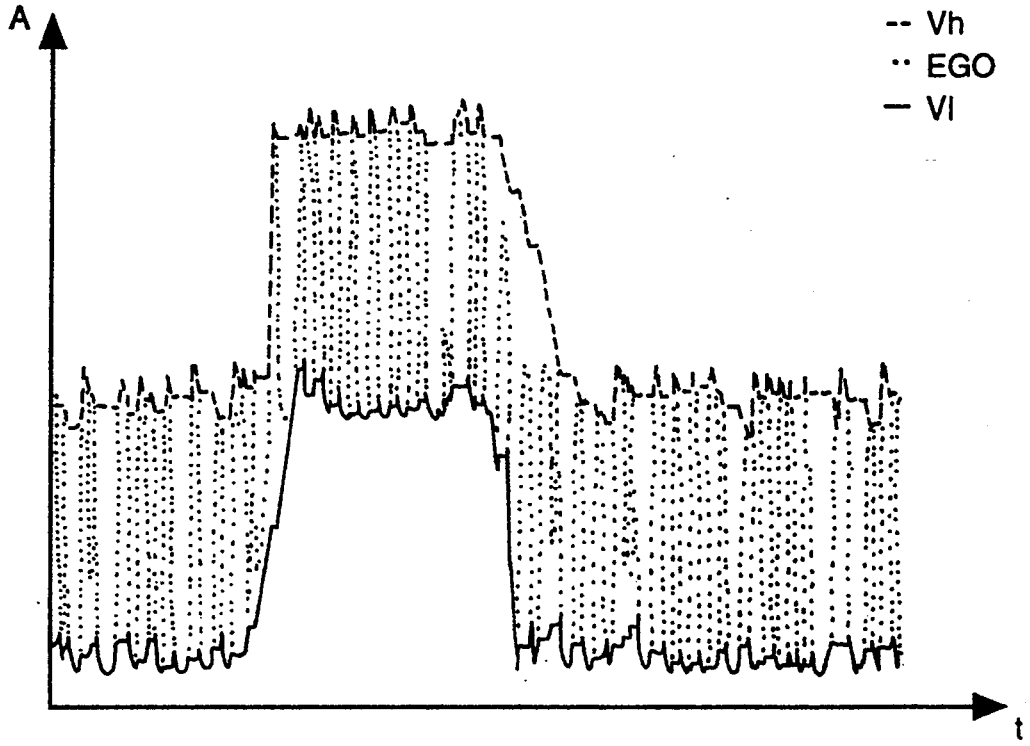
Figure 8:
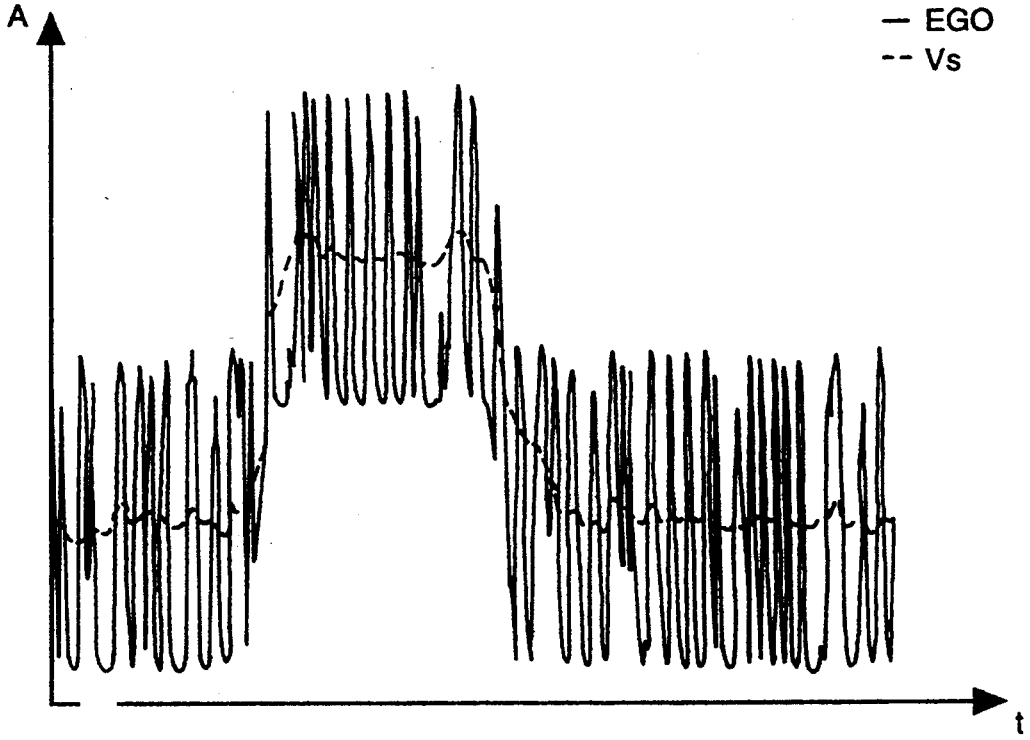

Advantages of the above described method for adaptively learning reference Vs are shown in FIGS. 7 and 8 during conditions where signal EGO incurs a sudden shift. More specifically, FIG. 7 shows a hypothetical operation wherein high voltage signal Vh and low voltage signal Vl accurately track the outer envelope of signal EGO and the resulting reference is shown accurately and continuously tracking the midpoint in peak-to-peak excursions of signal EGO in FIG. 8.

Although one example of an embodiment which practices the invention has been described herein, there are numerous other examples which could also be described. For example, the invention may be used to advantage with other types of exhaust gas oxygen sensors such as proportional sensors. Further, other combinations of analog devices and discrete ICs may be used to advantage to generate the current flow in the sensor electrode. The invention is therefore to be defined only in accordance with the following claims.

What is claimed:

1. An air/fuel control method for an internal combustion engine, comprising the steps of:

adjusting fuel delivered to the engine in response to a comparison of an output from an exhaust gas oxygen sensor to an adaptively learned reference signal;

generating said adaptively learned reference signal by determining a linear interpolation between a first signal and a second signal; and generating said first signal by storing said sensor signal as said first signal when said sensor signal is greater than a previously stored first signal and holding said first signal when said sensor signal is less than a previously stored reference signal and decreasing said first signal at a predetermined rate when said sensor signal is greater than said previously stored reference signal but less than said previously stored first signal.

2. The air/fuel control method recited in claim 1 further comprising the step of generating said second signal by storing said sensor signal as said second signal when said sensor signal is less than a previously stored second signal and holding said second signal when said sensor signal is greater than a previously stored reference signal and increasing said second signal at a predetermined rate when said sensor signal is less than said previously stored reference signal but greater than said previously stored second signal.

3. The air/fuel control method recited in claim 1 wherein said comparison step generates a two-state signal having a first state indicating exhaust gases are rich of stoichiometry and a second state indicating exhaust gases are lean of stoichiometry.

4. The air/fuel control method recited in claim 3 wherein said fuel adjusting step trims an open loop calculation of desired fuel to be delivered to the engine by a feedback variable generated by integrating said two-state signal.

5. The air/fuel control method recited in claim 4 wherein said open loop calculation comprises the step of dividing a measurement of airflow inducted into the engine by a desired air/fuel ratio.

6. The air/fuel control method recited in claim 5 wherein said step of trimming said open loop calculation comprises the step of dividing said open loop calculation by said feedback variable.

7. The air/fuel control method recited in claim 1 wherein said adjusting step is activated when preselected engine operating conditions exceed preselected values.

8. The air/fuel control method recited in claim 1 wherein said linear interpolation comprises a midpoint determination.

9. An air/fuel control method for an internal combustion engine, comprising the steps of:

maintaining an air/fuel mixture inducted into the engine near a desired air/fuel ratio in response to a comparison of an output from an exhaust gas oxygen sensor to an adaptively learned reference signal;

adaptively learning said reference signal by determining a midpoint between a first signal and a second signal during each of a repetitively occurring number of sample times;

during each of said sample times generating said first signal by storing said sensor signal as said first signal when said sensor signal is greater than said first signal from the previous sample time and holding said first signal when said sensor signal is less than said reference signal from the previous sample time and decreasing said first signal by a predetermined amount when said sensor signal is greater than said previously sampled reference signal but less than said previously sampled first signal; and during each of said sample times generating said second signal by storing said sensor signal as said second signal when said sensor signal is less than said second signal from the previous sample time and holding said second signal when said sensor signal is greater than said reference signal from the previous sample time and increasing said first signal by a predetermined amount when said sensor signal is less than said previously sampled reference signal but greater than said previously sampled first signal.

10. The air/fuel control method recited in claim 9 wherein said comparison step generates a two-state signal having a first state indicating exhaust gases are rich of stoichiometry and a second state indicating exhaust gases are lean of stoichiometry.

11. The air/fuel control method recited in claim 10 wherein said step of maintaining engine air/fuel ratio trims an open loop calculation of desired fuel to be delivered to the engine by a feedback variable generated by integrating said two-state signal.

12. An air/fuel control system for an internal combustion engine, comprising:

a controller maintaining an air/fuel mixture inducted into the engine near a desired air/fuel ratio in response to a feedback variable;

feedback means for generating said feedback variable by integrating a two-state signal generated by comparing an output from an exhaust gas oxygen sensor to an adaptively learned reference signal;

adaptive learning means for providing said reference signal by determining a midpoint between a first signal and a second signal during each of a repetitively occurring number of sample times;

first signal generating means for generating said first signal each of said sample times by storing said sensor signal as said first signal when said sensor signal is greater than said first signal from the previous sample time and holding said first signal when said sensor signal is less than said reference signal from the previous sample time and decreasing said first signal by a predetermined amount when said sensor signal is greater than said previously sampled reference signal but less than said previously sampled first signal; and second signal generating means for generating said second signal each of said sample times by storing said sensor signal as said second signal when said sensor signal is less than said second signal from the previous sample time and holding said second signal when said sensor signal is greater than said reference signal from the previous sample time and increasing said first signal by a predetermined amount when said sensor signal is less than said previously sampled reference signal but greater than said previously sampled first signal.

13. The system recited in claim 12 wherein said controller provides desired fuel quantity for delivery to the engine by dividing a measurement of airflow inducted into the engine by both a desired air/fuel ratio and said feedback variable.

* * * * *